US009927202B2

(12) United States Patent
Ives

(10) Patent No.: US 9,927,202 B2
(45) **Date of Patent: *Mar. 27, 2018**

(54) AMBIDEXTROUS RIFLE SYSTEM

(71) Applicant: Nemesis Arms, Inc., Calimesa, CA (US)

(72) Inventor: David Ives, Redlands, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/250,367

(22) Filed: Aug. 29, 2016

(65) Prior Publication Data

US 2016/0363410 A1 Dec. 15, 2016

Related U.S. Application Data

(63) Continuation of application No. 14/595,744, filed on Jan. 13, 2015, now Pat. No. 9,429,382.

(60) Provisional application No. 61/926,917, filed on Jan. 13, 2014.

(51) Int. Cl.

| | |
|---|---|
| ***F41A 35/06*** | (2006.01) |
| ***F41A 3/22*** | (2006.01) |
| ***F41A 3/66*** | (2006.01) |

(52) U.S. Cl.

CPC ..... *F41A 35/06* (2013.01); *F41A 3/22* (2013.01); *F41A 3/66* (2013.01)

(58) Field of Classification Search

CPC .... F41A 35/06; F41A 3/66; F41A 3/20; F41A 3/22

See application file for complete search history.

(56) References Cited

U.S. PATENT DOCUMENTS

| | | | | |
|---|---|---|---|---|
| 3,341,963 | A | 9/1967 | Seiderman | |
| 3,791,060 | A * | 2/1974 | Weaver | F41A 3/72 42/16 |
| 5,718,073 | A | 2/1998 | Sachse et al. | |
| 6,209,249 | B1 | 4/2001 | Borden | |
| 6,508,025 | B1 * | 1/2003 | Du Plessis | F41A 15/12 42/16 |
| 8,429,844 | B2 | 4/2013 | Dextraze et al. | |
| 9,038,303 | B1 * | 5/2015 | Olson | F41A 3/16 42/25 |
| 9,429,382 | B2 * | 8/2016 | Ives | F41A 3/22 |

OTHER PUBLICATIONS

Blaser Hunting Rifles: R8, Apr. 2, 2013, Blaser, pp. 1 and 2.*
Blaser USA, Inside Blaser: Assembling your R8 Rifle. Return to Zero & Converting from Right to Left Handed, Sep. 11, 2015, YouTube, all pages, video from 3:45 to 4:10.*
Rifle Bolt Fluting—Is it Worth the Money? Just for Looks?, May 3, 2012, thealaskalife.com, all pages.*

(Continued)

*Primary Examiner* — Stephen Johnson
*Assistant Examiner* — Joshua T Semick
(74) *Attorney, Agent, or Firm* — Snell & Wilmer L.L.P.

(57) ABSTRACT

An ambidextrous rifle system, method and apparatus are provided. The rifle system may comprise a receiver configured to receive and carry a switch bolt system. The switch bolt system may comprise a first bolt and a second bolt. The first bolt may be configured for a right handed shooter. The second bolt may be configured for a left handed shooter. The first bolt and the second bolt may be moveable within the receiver between the battery and out of battery positions.

18 Claims, 10 Drawing Sheets

(56) References Cited

OTHER PUBLICATIONS

MidwayUSA, Gunsmithing—How to Drill and Tap a Mauser Rifle Receiver for Scope Base Installation, Jun. 16, 2008, YouTube.*
The SABER-FORSST Modular Rifle Chassis System, Nov. 8, 2012, Ashbury Precision Ordnance, Mfg.*
Non-Final office action dated Aug. 14, 2015 in U.S. Appl. No. 14/595,744.
Final office action dated Mar. 7, 2016 in U.S. Appl. No. 14/595,744.
Notice of Allowance dated Jun. 29, 2016 in U.S. Appl. No. 14/595,744.
Accurate Shooter, SHOT Show Report: Accuracy International PSR Rifle System, Jan. 21, 2013.
Desert Tech, Shooting SRS Bolt Action Left Handed, YouTube, Jun. 14, 2011.

* cited by examiner

AMBIDEXTROUS RIFLE SYSTEM

CROSS REFERENCE TO RELATED APPLICATIONS

This application is a continuation of U.S. Ser. No. 14/595,744 filed on Jan. 13, 2015, now U.S. Pat. No. 9,429,382 entitled "AMBIDEXTROUS RIFLE SYSTEM." U.S. Ser. No. 14/595,744 claims the benefit of and priority to U.S. Ser. No. 61/926,917, entitled "AMBIDEXTROUS RIFLE SYSTEM, APPARATUS AND METHOD" filed on Jan. 13, 2014, which is incorporated herein by reference in its entirety for any purpose.

FIELD

The present disclosure relates firearms, and more specifically, to an ambidextrous rifle system, method and apparatus.

BACKGROUND

Typical firearms and more specifically bolt action firearms are often configured for right-handed shooters or left-handed shooters. In military and law enforcement applications, this can increase the expense associated for the organization by having to maintain a firearms inventory for both left- and right-handed shooters. Typically, a law enforcement organization and/or military branch will order a first quantity of right-handed firearms and a second lesser quantity of left-handed firearms.

SUMMARY

In various embodiments, a rifle system may comprise a first bolt, a second bolt and a receiver. The first bolt may comprise a first handle configured for engagement by a right handed shooter. The first bolt may be configured to rotate in a first direction. The second bolt may comprise a second handle configured for engagement by a left handed shooter. The second bolt may be configured to rotate in a second direction. The receiver may define a bolt channel. The bolt channel may be configured to receive the first bolt and the second bolt. The first bolt may be movable between a battery position and an out of battery position by rotating in the first direction.

In various embodiments, a bolt action rifle receiver may comprise a bolt release mechanism and a body. The body may define a channel. The bolt release mechanism may be installed on the body. The body may be configured to receive a switch bolt system. The switch bolt system may comprise a first bolt configured for installation within the channel. The first bolt may be removably retained by the bolt release mechanism. The switch bolt system may also comprise a second bolt configured for installation within the channel. The second bolt may be removably retained by the bolt release mechanism. The first bolt may be configured to rotate in a first direction between a battery position and an out of battery position. The second bolt may be configured to rotate in a second direction between the battery position and the out of battery position.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

In various embodiments, an ambidextrous bolt action firearm system is provided. The firearm system may be configured with a switch bolt system. The switch bolt system may be a first bolt configured for a right-handed shooter and a second bolt configured for a left-handed shooter. Each of the first bolt and the second bolt may be receivable within a receiver configured to accept both the right-handed bolt and the left-handed bolt. Moreover, each of the first bolt and the second bolt may be movable within the receiver between the battery and out of battery positions.

Figure 1:
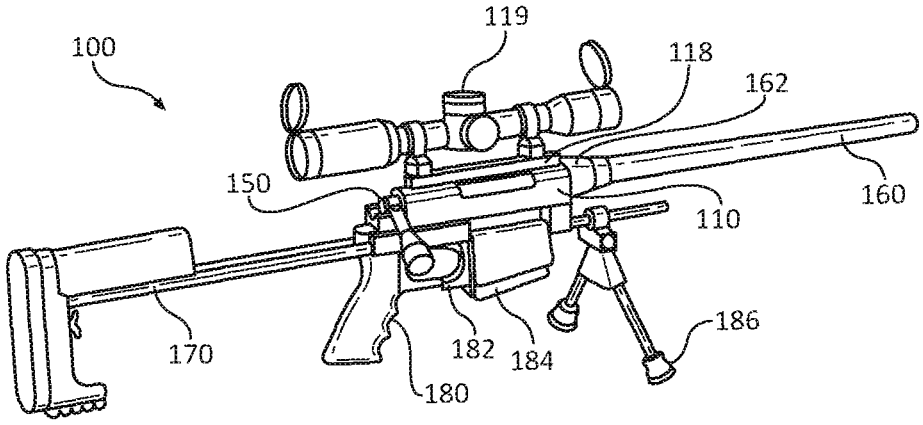
FIG. 1 illustrates a rifle system, in accordance with various embodiments.

In various embodiments and with reference to FIG. 1, rifle system 100 may be any suitable rifle that is capable of receiving a switch bolt system. More specifically, rifle system 100 may be a bolt action rifle. Rifle system 100 may comprise a receiver 110, a bolt 150, a barrel 160, a stock 170, a grip and/or lower assembly 180.

In various embodiments, barrel 160 may operatively and/or removably couple to receiver 110 by a barrel nut 162. Barrel 160 may comprise a chamber and rifling for any suitable caliber of ammunition. Barrel 160 may be made of any suitable material and may have any suitable coating.

In various embodiments, receiver 110 may comprise and/or removably couple to a trigger system 182. Receiver 110 may also be configured with an accessory rail 118. Accessory rail 118 may be configured in any suitable fashion to accept and/or receive an accessory 119 (e.g., an optic, a light, a laser, and/or the like). Receiver 110 may operatively couple to and/or mount to stock system 170 and/or lower assembly 180. Stock system 170 may be any suitable stock including a collapsible stock, a multi-position stock and/or the like. Lower assembly 180 may comprise a handle, a removable magazine insertable in a magazine well 184 and/or various other components. Rifle system 100 may be configured to attach to a bipod 186 or other suitable support structure.

In various embodiments and with reference to FIGS. 2A through 2E, receiver 210 may comprise a threaded portion 212. Threaded portion 212 may operatively couple to a barrel (e.g., barrel 160 as shown in FIG. 1) and/or a barrel nut (e.g., barrel nut 162 as shown in FIG. 1). Receiver 210 may also comprise an ejection port 230. Ejection port 230 may be configured to discharge ammunition and/or cases from spent or fired ammunition. Ejection port 230 may be configured to eject ammunition and/or cases to one side regardless of the orientation of the rifle system. For example, ammunition and/or cases may be ejected from either the right side or the left side. In this regard, the ejection port is fixed.

In various embodiments, receiver 210 may comprise a bolt release 242. Bolt release 242 may comprise a retaining element. The retaining element may be removed and/or actuated to release a bolt housed in receiver 210. Bolt release 242 may be a levered arm pivoting about a fixed location (e.g., a rod). Bolt release 242 may also be a detent assembly, a switch, and/or the like.

In various embodiments, receiver 210 may also comprise a stock release 244. Stock release 244 may allow a stock (e.g. stock system 170 as shown in FIG. 1) to be adjustable relative to receiver 210.

Receiver 210 may define a bolt channel 220. Bolt channel 220 may be configured to receive and carry a bolt. Bolt channel 220 may also provide a path and/or carry the bolt between a battery position and an out of battery position. Receiver 210 may also comprise a retaining lug 214. Receiver 210 may also comprise bolt handle slot 216. The bolt may be housed within bolt channel 220 such that the handle of the bolt may protrude from the back of receiver 210 and may ride and/or rest in bolt handle slot 216. Moreover, the back face of the bolt may be positioned adjacent retaining lug 214 such that the bolt can be retained by the lug when the rifle system is operated (e.g., when ammunition is fired from the rifle).

Figure 2A:
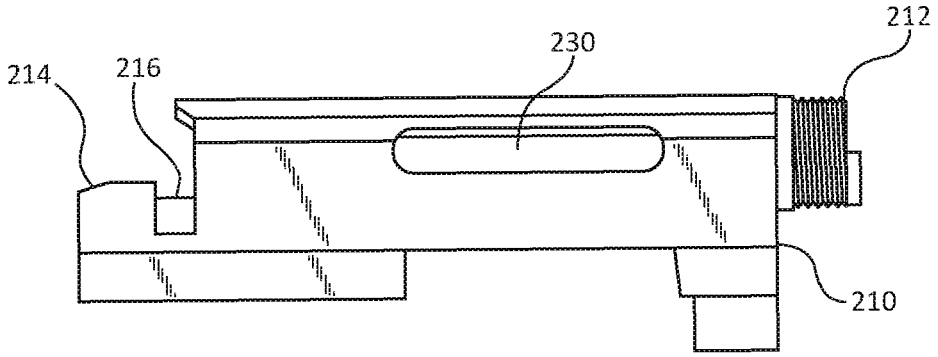
FIG. 2A illustrates a first side view of a receiver, in accordance with various embodiments.
Figure 2B:
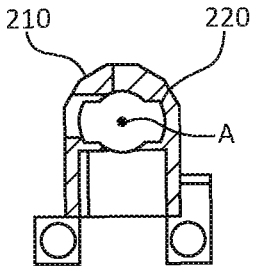
FIG. 2B illustrates a back view of a receiver, in accordance with various embodiments.
Figure 2C:
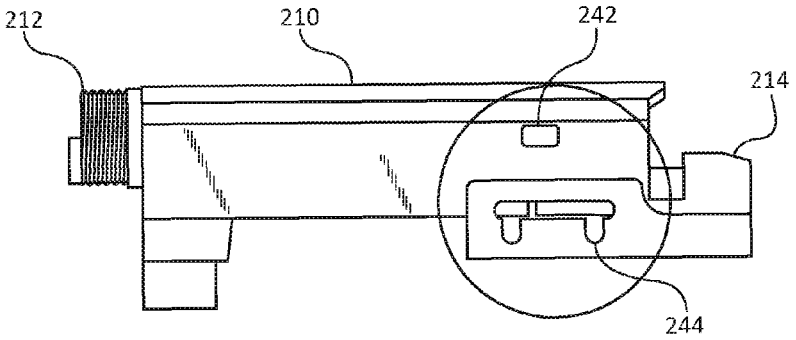
FIG. 2C illustrates a second side view of a receiver, in accordance with various embodiments.
Figure 2D:
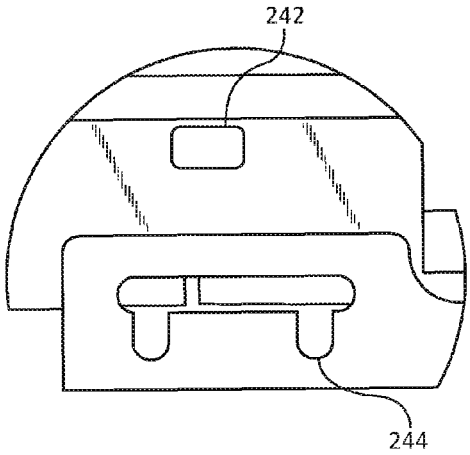
FIG. 2D illustrates a side view of a portion of a receiver, in accordance with various embodiments.
Figure 2E:
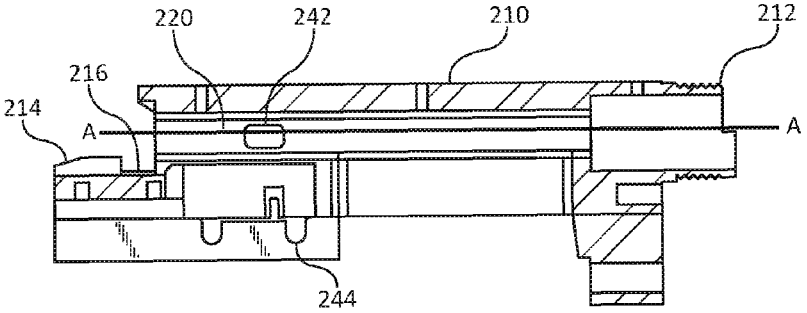
FIG. 2E illustrates a cross-sectional view of a receiver, in accordance with various embodiments.
Figure 3A:
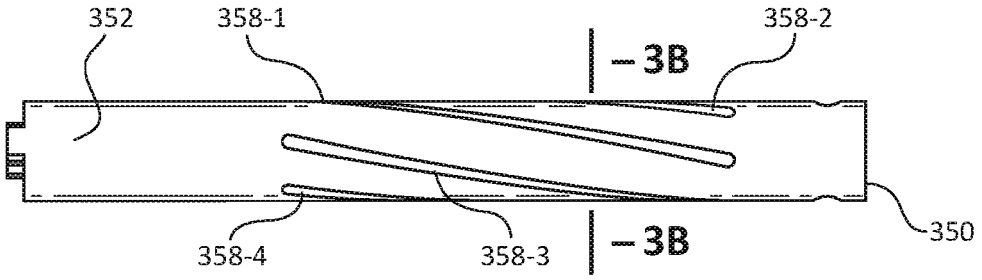
FIG. 3A illustrates a side view of a portion of a right handed bolt, in accordance with various embodiments.
Figure 3B:
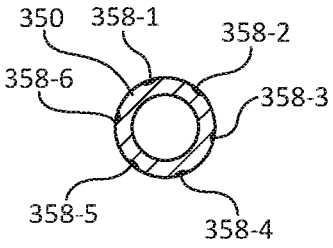
FIG. 3B illustrates a cross-sectional view of a bolt, in accordance with various embodiments.
Figure 3C:
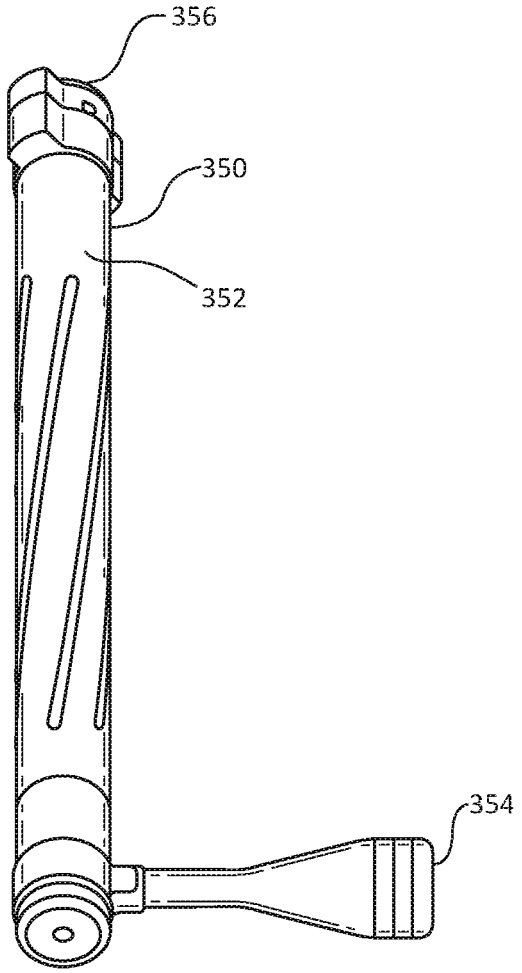
FIG. 3C illustrates a top view of a right handed bolt, in accordance with various embodiments.
Figure 4A:
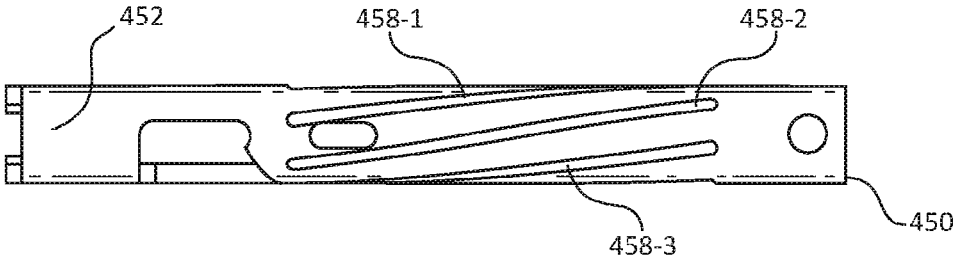
FIG. 4A illustrates a side view of a portion of a left handed bolt, in accordance with various embodiments.
Figure 4B:
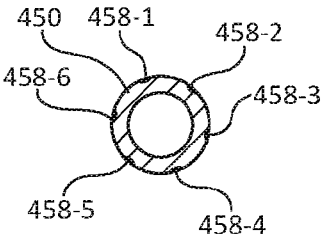
FIG. 4B illustrates a cross-sectional view of a bolt, in accordance with various embodiments.

In various embodiments and with specific reference to FIG. 2B, FIG. 3C, and FIG. 4B, bolt channel 220 (e.g., the bolt guide, bolt raceway, and/or the like) may be symmetric about its centerline A. Bolt channel 220 may be cut (e.g., by electrical discharge machining) to have a smooth surface (e.g., a surface like a bearing race). Bolt channel 220 may have a butterfly wing shape and/or a slot and tube shape as shown in FIG. 2B. Moreover, bolt channel 220 may be configured to receive and carry a right-handed bolt 350 and a left-handed bolt 450.

In various embodiments and with reference to FIGS. 3A through 3C, bolt 350 (e.g., a right-handed bolt) may comprise a bolt body 352, a handle 354, and a bolt face 356. Bolt 350 may also comprise a plurality of flutes 358 (shown as 358-1, 358-2, 358-3, and 358-4 in FIG. 3A). The flutes may define, guide, and/or manage rotation (e.g., rotation in the counterclockwise direction as the bolt is rotated from the battery position to the out of battery position) of the bolt when bolt 350 is actuated via handle 354 by a user. In this regard, flutes 358 may be uniformly offset from one another and may follow a curving path about bolt body 352. More specifically, flutes 358 may be set off from each other at a fixed angle such as, for example, approximately 60 degrees as shown in FIG. 3B. In this regard, flute 358-1 may be located 60 degrees from flute 358-2 when viewed on a cross-section of bolt body 352 as shown in FIG. 3B.

Figure 4C:
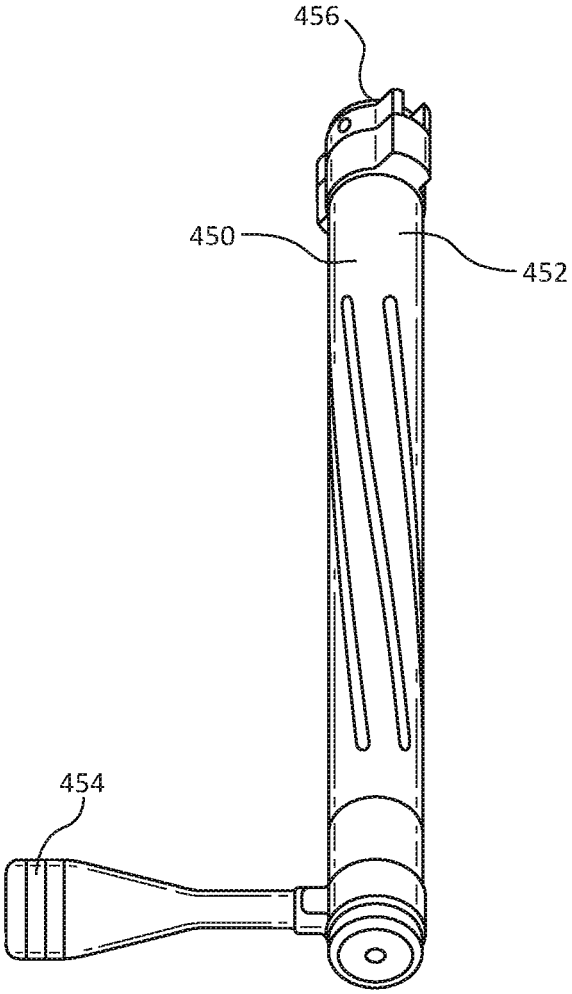
FIG. 4C illustrates a top view of a left handed bolt, in accordance with various embodiments.

In various embodiments and with reference to FIGS. 4A through 4C, bolt 450 (e.g., a left handed bolt) may be moveably received within receiver 210. Like bolt 350, bolt 450 may comprise a bolt body 452, a bolt handle 454, and a bolt face 456. Bolt body 452 may also comprise a plurality of flutes 458 (shown as flute 458-1, flute 458-2, and flute 458-3 as shown in FIG. 4A). Flutes 458 may define, guide, and/or manage rotation (e.g., rotation in the clockwise direction as bolt 450 is rotated from the battery position to the out of battery position) of the bolt when bolt 450 is actuated via bolt handle 454 by a user. In this regard, flutes 458 may be uniformly offset from one another and may follow a curving path about bolt body 452. More specifically, flutes 458 may be set off from each other at a fixed angle such as, for example, approximately 60 degrees as shown in FIG. 4B. In this regard, flute 458-1 may be located 60 degrees from flute 458-2 when viewed on a cross-section of bolt body 452 as shown in FIG. 4B.

In various embodiments and with reference to FIGS. 3A-3C and 4A-4C, bolt 350/450 may comprise a bolt face 356/456 that includes two or more lugs (e.g., lugs to lock the chamber in the battery position). In this regard, bolt 350/450 may be a 90° bolt where bolt 350/450 comprises two (2) lugs. Bolt 350/450 may be a 60° bolt where bolt 350/450 comprises three (3) lugs. In various embodiments, bolt 350/450 may comprise any number of lugs greater than two (2) lugs.

Figure 5A:
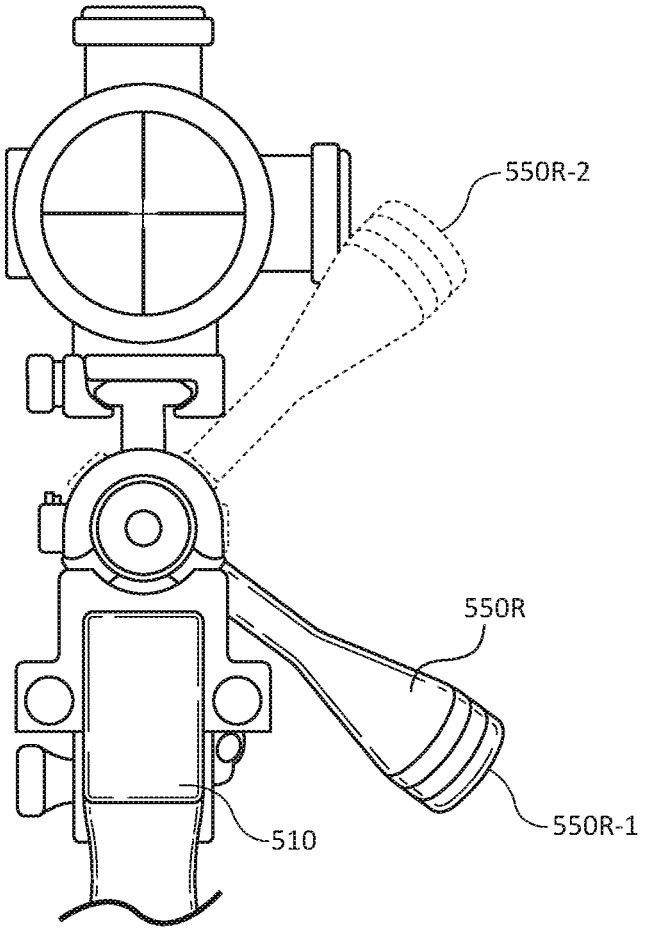
FIG. 5A shows the rotation of a right-handed bolt of a switch bolt system, in accordance with various embodiments.
Figure 5B:
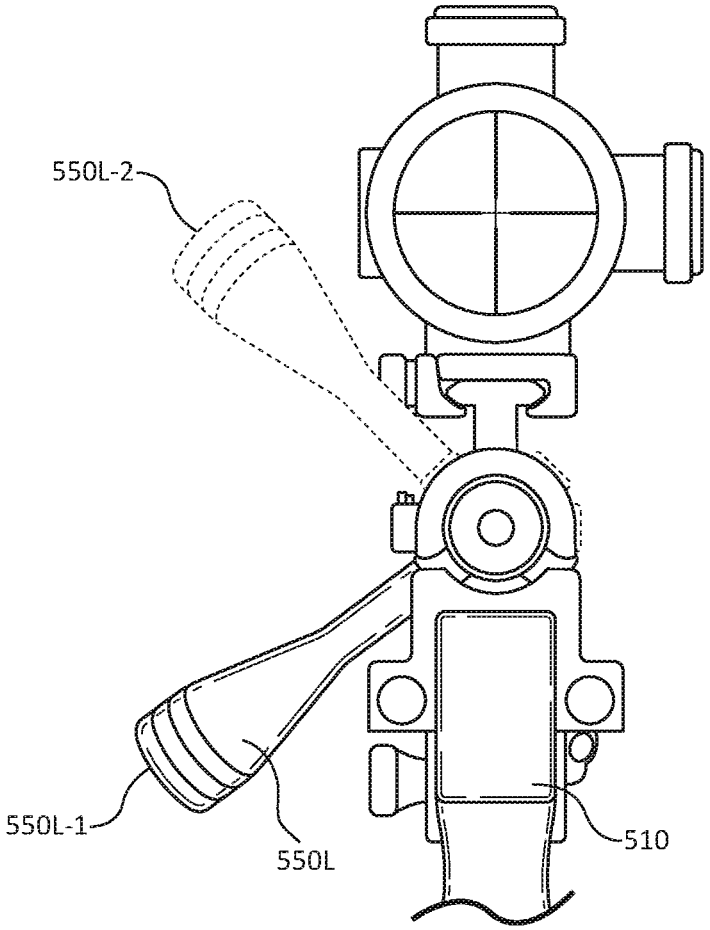
FIG. 5B shows the rotation of a right-handed bolt of a switch bolt system, in accordance with various embodiments.

In various embodiments and with reference to FIG. 1 and FIGS. 5A and 5B, in operation, rifle system 100 may be configured to receive and operate with either a bolt 550R or a bolt 550L. In operation and in a right-handed configuration, bolt 550R may be installed in receiver 510. Bolt 550R may be actuated in a counterclockwise direction from a first position 550R-1 (e.g., where bolt 550R is in the battery position) to a second position 550R-2 (e.g., where the bolt 550R is in the out of battery position). The path of rotation from first position 550R-1 to second position 550R-2 may be any suitable rotational distance including, for example, 30°, 60°, 90°, and/or the like. In this regard, the rotational distance may be a function of the number of lugs the bolt 550R. In a left-handed configuration, bolt 550L may be actuated in a clockwise direction from a first position 550L-1 (e.g., where bolt 550L is in the battery position) to a second position 550L-2 (e.g., where the bolt 550L is in the out of battery position). The path of rotation from first position 550L-1 to second position 550L-2 may be any suitable rotational distance including, for example, 30°, 60°, 90°, and/or the like. In this regard, the rotational distance may be a function of the number of lugs on the bolt 550L.

Figure 6A:
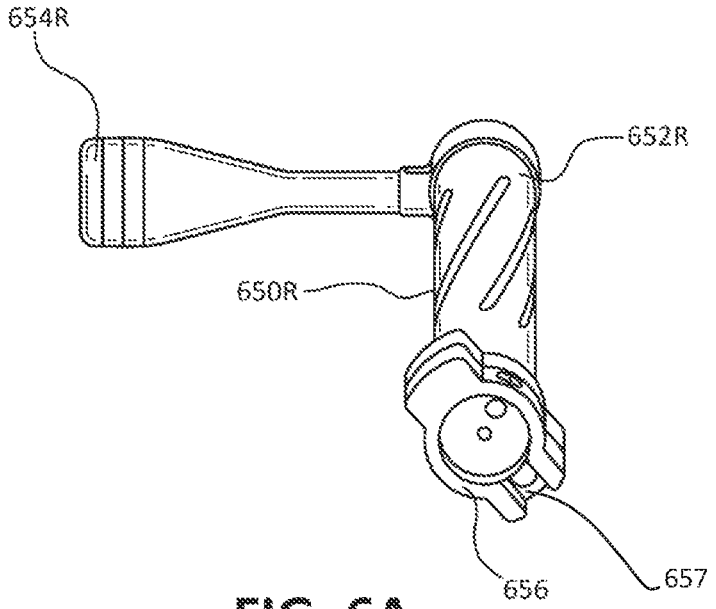
FIG. 6A shows a perspective bolt face view of a right-handed bolt, in accordance with various embodiments.
Figure 6B:
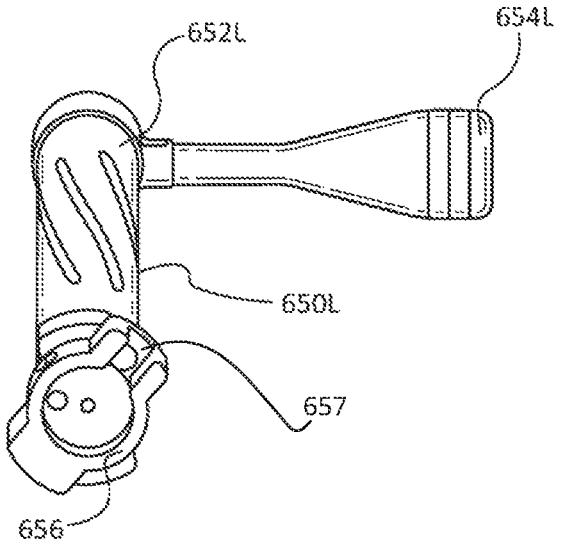
FIG. 6B shows a perspective bolt face view of a left-handed bolt, in accordance with various embodiments.

In various embodiments and with reference to FIGS. 6A-6B, bolt 650R and 650L may each comprise a bolt face 656. Bolt face 656 may be any suitable bolt face. Bolt face 656 is configured with extractor slot 657. Moreover, bolt 650R and bolt 650L may each comprise bolt face 656 that is configured for right-handed extraction and/or ejection. In this regard, bolt face 656 of bolt 650R is substantially the same as bolt face 656 of bolt 650L. Bolt 650R also comprises bolt body 652R and bolt handle 654R; bolt 650L also comprises bolt body 652L and bolt handle 654L. Moreover, in an exemplary embodiment, in bolt 650R, bolt face 656 is configured such that extractor slot 657 is disposed in the lug that is furthest away from (or opposite) bolt handle 654R; in bolt 650L, bolt face 656 is configured such that extractor slot 657 is disposed in the lug that is closest to (or adjacent) bolt handle 654L.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A rifle system, comprising:

a receiver defining a bolt channel for receiving a first bolt or a second bolt, the receiver further comprising a single ejection port disposed on a first side of the receiver;

the first bolt removably coupleable to the receiver in the bolt channel, the first bolt comprising a first handle, wherein, when the first bolt is received in the bolt channel, the first bolt is rotatable in a counterclockwise direction from a battery position to an out of battery position, and the first handle extends outward on a right side of the receiver; and the second bolt removably coupleable to the receiver in the bolt channel, the second bolt comprising a second handle, wherein, when the second bolt is received in the bolt channel, the second bolt is rotatable in a clockwise direction from a battery position to an out of battery position, and the second handle extends outward on a left side of the receiver, wherein the first bolt has a first longitudinal axis, and the first bolt further comprises a first bolt face having an extractor slot disposed in a lug that is positioned on an opposite side of the first longitudinal axis as the first handle, wherein the second bolt has a second longitudinal axis, and the second bolt further comprises a second bolt face having an extractor slot disposed in a lug that is positioned on a common side of the second longitudinal axis as the second handle, wherein, responsive to operation of the rifle system with either the first bolt or the second bolt, cartridges are ejected through the single ejection port.

2. The rifle system of claim 1, wherein the first bolt comprises a plurality of flutes having a first orientation.

3. The rifle system of claim 2, wherein the second bolt comprises a plurality of flutes having a second orientation.

4. The rifle system of claim 1, wherein the bolt channel has a butterfly wing shape.

5. The rifle system of claim 1, wherein the bolt channel is substantially symmetric about its centerline.

6. The rifle system of claim 1, wherein the first bolt comprises a first bolt face.

7. The rifle system of claim 6, wherein the second bolt comprises a second bolt face.

8. The rifle system of claim 1, further comprising a trigger system coupled to the receiver.

9. The rifle system of claim 1, wherein the receiver is configured to detachably couple to a barrel.

10. The rifle system of claim 1, wherein the rotation of the first bolt between the battery position of the first bolt and the out of battery position of the first bolt is approximately 30° to approximately 90° counterclockwise.

11. The rifle system of claim 10, wherein the rotation of the second bolt between the battery position of the second bolt and the out of battery position of the second bolt is approximately 30° to approximately 90° clockwise.

12. The rifle system of claim 1, further comprising a lower assembly coupled to the receiver, wherein the lower assembly comprises at least one of a handle or a magazine well.

13. The rifle system of claim 1, further comprising an accessory rail coupled to the receiver, wherein the accessory rail comprises at least one of an optic, a light, or a laser.

14. The rifle system of claim 1, further comprising a stock system coupled to the receiver, wherein the stock system comprises a collapsible stock.

15. A method of operating an ambidextrous rifle system, the method comprising:

inserting a first bolt into a bolt channel of a receiver of the ambidextrous rifle system, wherein the receiver comprises a single ejection port disposed on a first side of the receiver;

rotating the first bolt in a counterclockwise direction from a battery position to an out of battery position;

removing the first bolt from the bolt channel of the receiver;

inserting a second bolt into the bolt channel of the receiver; and rotating the second bolt in a clockwise direction from a battery position to an out of battery position, wherein the first bolt has a first longitudinal axis, the first bolt comprises a first handle and a first bolt face, and the first bolt face has an extractor slot disposed in a lug that is positioned on an opposite side of the first longitudinal axis as the first handle, wherein the second bolt has a second longitudinal axis, the second bolt comprises a second handle and a second bolt face, and the second bolt face has an extractor slot disposed in a lug that is positioned on a common side of the second longitudinal axis as the second handle, wherein, during operation of the ambidextrous rifle system with either the first bolt or the second bolt, cartridges are ejected through the single ejection port.

16. The method of claim 15, further comprising attaching an accessory rail to the receiver, wherein the accessory rail is configured to receive at least one of an optic, a light, or a laser.

17. The method of claim 15, further comprising attaching a stock system to the receiver, wherein the stock system is adjustable relative to the receiver.

18. The method of claim 15, further comprising attaching a lower assembly to the receiver, wherein the lower assembly comprises at least one of a handle or a magazine well.

* * * * *